United States Patent [19]

Joly et al.

[11] 3,952,386

[45] Apr. 27, 1976

[54] APPARATUS FOR INTERLACING STRANDS OF A TEXTILE YARN

[75] Inventors: Jean Joly, Craponne; Silvio Sangalli, Caluire, both of France

[73] Assignee: Rhone-Poulenc-Textile, Paris, France

[22] Filed: Dec. 5, 1974

[21] Appl. No.: 529,906

Related U.S. Application Data

[62] Division of Ser. No. 363,561, May 24, 1973, Pat. No. 3,889,327.

[30] Foreign Application Priority Data

May 26, 1972 France ..... 72.19404

[52] U.S. Cl. ..... 28/1.4

[51] Int. Cl.[2] ..... D02G 1/16

[58] Field of Search ..... 28/1.4, 72.12; 57/34 B, 57/157 F; 226/108; 239/69, 99, 101

[56] References Cited

UNITED STATES PATENTS

| | | | |
|---|---|---|---|
| 3,828,404 | 8/1974 | Peckinpaugh et al. | 28/1.4 |
| 3,831,363 | 8/1974 | Pike | 28/1.4 X |
| 3,835,511 | 9/1974 | Schrader et al. | 28/1.4 |

*Primary Examiner*—Louis K. Rimrodt

*Attorney, Agent, or Firm*—Sherman & Shalloway

[57] ABSTRACT

A method for interlacing strands of a textile yarn by subjecting the yarn to a fluid current varying in direction and flow as the yarn passes through an interlacing zone under tension, and apparatus for implementing the interlacing method including an interlacing chamber having at least one element movably disposed in the interlacing chamber and movable by the fluid current to deflect the fluid current to vary the direction and flow of the fluid current.

6 Claims, 5 Drawing Figures

APPARATUS FOR INTERLACING STRANDS OF A TEXTILE YARN

This is a division of application Ser. No. 363,561, filed May 24, 1973, now U.S. Pat. No. 3,889,327, granted June 17, 1975.

BACKGROUND OF THE INVENTION

1. Field of the invention

The present invention pertains to interlacing textile yarns and, more particularly, to a method and apparatus for interlacing the strands of a textile yarn with a fluid current.

2. Discussion of the prior art

Various methods are known in the prior art for producing yarns with interlaced strands, that is, yarns having continuous multifilaments which have been subjected to an interlacing operation to provide the multifilaments with cohesion in place of twisting or twisting and sizing. A "yarn having interlaced strands" or an "interlaced yarn" is formed of continuous multi-filaments, the elementary filaments being interlaced or tangled in a disordered fashion forming "pseudo-knots" in order to produce a yarn having an approximately zero overall twist. Conventional yarn interlacing methods subject the yarn moving under slight tension between two yarn guides in an interlacing zone to the action of a fluid current, normally a jet of compressed air; and, in practice, the jet of compressed air is directed in a plane substantially transverse to the advancing direction of the yarn.

In one prior art method of interlacing yarns, as exemplified by the patent of addition 68,429 to French Pat. No. 1,108,890, the yarn is moved between a nozzle and a resonance box, and in an improvement over the above method, as exemplified by French Pat. No. 1,334,130, the fluid jet is picked up at the outlet of the resonance box to act on the yarn again. In a further prior art method of interlacing yarn, as exemplified by French Pat. No. 1,305,832, the yarn is disposed in a zone of swirling controlled turbulence to have axes of rotation substantially parallel to the advancing direction of the yarn, and one particular manner of implementing this method utilizes a vibrating reed. As exemplified by French Pat. No. 1,492,945, another prior art method of interlacing yarn contemplates simultaneously subjecting the yarn to the action of at least a pair of primary fluid jets and at least one secondary fluid jet acting on the yarn in a direction opposite that of the primary fluid jets and in a zone disposed between the points of impact of the primary fluid jets on the yarn.

All of the above described methods for interlacing yarn known in the prior art include the step of subjecting the yarn to the action of fluid current having a constant or stationary direction and generally a constant output or flow and, while the above described processes are operative to interlace strands of the yarn, such interlacing is not as consistent or as easily obtained as is desirable.

SUMMARY OF THE INVENTION

Accordingly, it is a primary object of the present invention to overcome the disadvantages of the prior art by providing a method and apparatus for interlacing strands of a textile yarn by means of a fluid current by constantly subjecting the yarn moving under slight tension between two yarn guides in an interlacing zone to the action of at least one disrupted or disordered fluid current particularly with respect to the direction of impact of the fluid current on the yarn and, further, with respect to the flow of the fluid current.

Another object of the present invention is to interlace strands of a yarn by subjecting the yarn to a fluid jet or current with the direction and/or flow of the fluid jet variable in time.

A further object of the present invention is to disorder or disrupt a fluid current for treating a yarn in an interlacing zone by deflecting the fluid current or varying the flow output of the fluid current or simultaneously deflecting and varying the flow current.

The present invention has an additional object in apparatus for interlacing strands of a textile yarn including mechanical elements, such as one or more movable objects, presenting obstacles to a fluid current prior to its reaching the yarn such that the elements act on the fluid current to vary both the output flow and the direction of the current to create fluid currents which are constantly, randomly variable.

Yet another object of the present invention is to simultaneously subject a yarn to the action of a plurality of disrupted fluid currents, the original direction of the fluid currents prior to deflection having any desired relation to the direction of movement of the yarn either oblique or perpendicular and the nozzles forming the fluid currents being disposed in the same plane or distributed at different levels along the path of movement of the yarn.

A further object of the present invention is to provide apparatus for interlacing yarn including a housing defining an interlacing chamber for passage of the yarn therethrough, at least one inlet nozzle for supplying a stable fluid current to the interlacing chamber and means for disturbing or disordering the fluid current to vary the impact on the yarn.

An additional object of the present invention is to interlace yarn utilizing apparatus including a housing defining a cylindrical interlacing chamber for passage of the yarn, at least one nozzle disposed in non-radial relation to the axis of the housing for introducing a fluid current in the interlacing chamber, and at least one mechanical element movably disposed within the interlacing chamber and movable to deflect the fluid current. The yarn preferably passes axially through the cylindrical interlacing chamber, and the mchanical elements are preferably solids of a simple shape, advantageously balls or spheres, freely disposed within the interlacing chamber for movement and rotation by the fluid current.

The present invention has another object in that apparatus for interlacing yarn includes a cylindrical housing with a coaxial conduit therein provided with ports for introducing a fluid current, the annular space between the coaxial conduit and the housing containing movable balls to mechanically vary the fluid current.

Some of the advantages of the present invention over the prior art are that over a short period of time, that is approximately thousandths of a second, the interlacing is extremely heterogeneous and not accomplished in accordance with any prescribed law whereas, over the long term, that is a period of a second, a stable permanent interlaced condition is provided, the interlacing having a constant base such that over a small length of yarn, the strands are interlaced in a completely random fashion without a defined geometric pattern whereas, over a long length, the interlaced yarn presents a very pleasing regular appearance to the naked eye.

The present invention is generally characterized in a method for interlacing strands of a textile yarn including the steps of moving the yarn under tension through an interlacing zone; and subjecting the yarn in the interlacing zone to a fluid current varying in direction of impact upon the yarn. The present invention is further characterized in apparatus for interlacing strands of a textile yarn including a housing defining an interlacing chamber for passage of the textile yarn, means for introducing a fluid current into the chamber for treating the yarn, and means for disturbing the fluid current introduced into the interlacing chamber to vary the impact of the fluid current on the yarn.

Other objects and advantages of the present invention will become apparent from the following description of the preferred embodiments taken in conjunction with the accompanying drawings.

DESCRIPTION OF THE PREFERRED EMBODIMENTS

Figure 1:
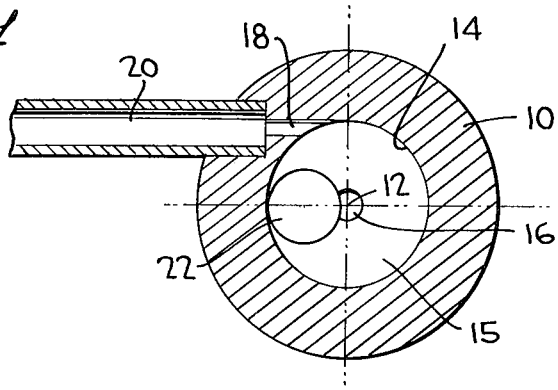
FIG. 1 is a top view in section of apparatus for interlacing yarn according to the present invention.

Apparatus for interlacing stands of a yarn according to the present invention is illustrated in FIG. 1 and includes a cylindrical housing 10 having a longitudinal axis 12 coinciding with a path through a cylindrical interlacing chamber 14 in the housing 10 along which yarn moves between a pair of yarn guides, not shown, under slight tension by any suitable means. The housing 10 has end plates 15 covering each end with coaxially aligned inlet and outlet openings 16 therein to permit passage of the yarn through the housing 10. A nozzle 18 is formed in the housing 10 to communicate with interlacing chamber 14 and a conduit 20 adapted to communicate with a source of compressed air such that a stable fluid current issues from nozzle 18 into interlacing chamber 14 tangentially in relation to the interlacing chamber. A sperical ball 22 having a diameter equal to substantially half the diameter of interlacing chamber 14 is movably disposed within the interlacing chamber in the housing 10 in such a manner that the ball 22 is movable and rotatable, preferably such movement being limited by the end plates.

In operation, as the yarn passes along axis 12 under slight tension through the chamber 14 in the housing 10, the fluid current supplied by nozzle 18 is deflected by a sphere or ball 22 to constantly vary or fluctuate the direction of impact of the fluid current on the yarn as wall as to vary or fluctuate the flow or output of the fluid current to which the yarn is subjected.

Figure 2:
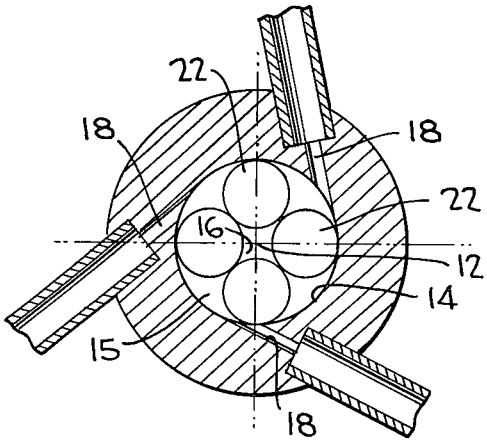
FIG. 2 is a top view in section of another embodiment of apparatus for interlacing yarn according to the present invention.

Another embodiment of apparatus for interlacing strands of a textile yarn according to the present invention is illustrated in FIG. 2 and differs from the apparatus of FIG. 1 primarily only in that the housing 10 has three equally spaced nozzles 18 therein receiving compressed air from three conduits 20, respectively, to supply three fluid current tangentially to the interlacing chamber 14 and four spherical balls 22 are movably and rotatably disposed in the interlacing chamber 14 such that the fluid currents issuing from nozzles 18 in non-radial relation to the axis 12 are deflected by the balls 22 to disrupt the fluid currents and constantly, randomly vary the direction of impact of the fluid currents on the yarn passing through the interlacing chamber 14 as well as randomly varying the flow of the fluid currents. Thus, the operation of the apparatus of FIG. 2 is similar to the operation of the apparatus of FIG. 1 in that fluid currents issuing from nozzles 18 are disturbed by balls 22 which rotate and move such that the yarn is contacted with disordered fluid currents, the movement of the balls 22 being limited by the end plates 15.

Figure 3:
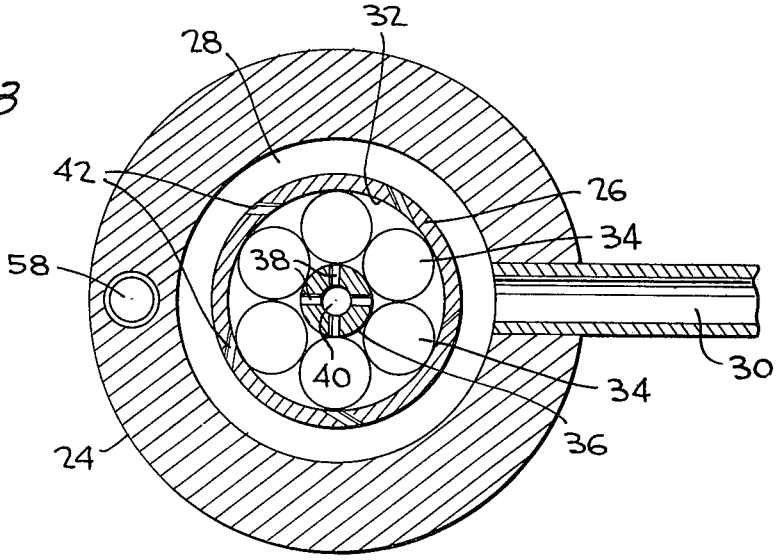
FIG. 3 is a top view in section of a further embodiment of apparatus for interlacing yarn according to the present invention.
Figure 4:
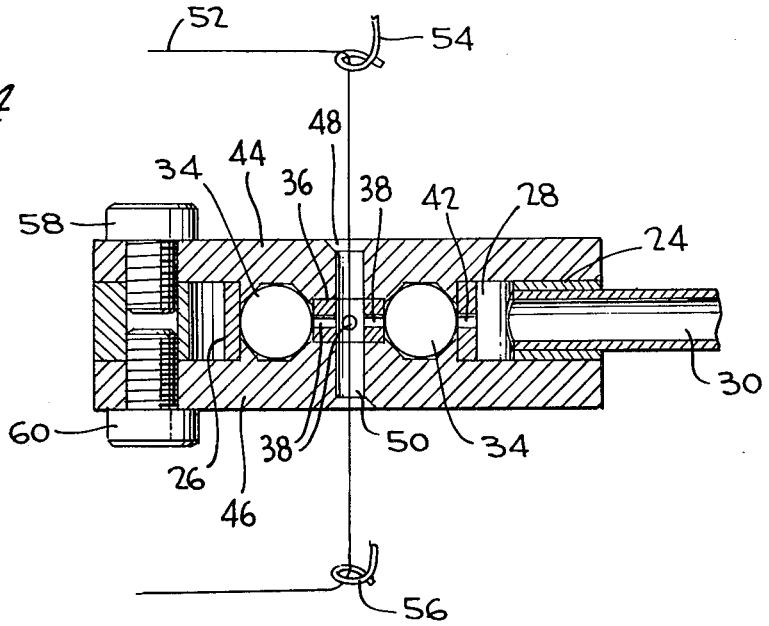
FIG. 4 is an elevational view in section of the apparatus of FIG. 3 taken along line 4—4.

A further embodiment of apparatus for interlacing strands of a textile yarn is illustrated in FIGS. 3 and 4 and includes a cylindrical housing 24 with a cylindrical wall 26 therein to define an annular space therebetween forming a manifold 28 for a source of compressed air, not shown, via a conduit 30 extending through the wall of housing 24. Cylindrical wall 26 defines an interlacing chamber 32 therein wherein six spherical balls 34 are disposed around a barrel 36 having four equally spaced ports 38 extending therethrough and arranged radially in relation to the path of the yarn through the central longitudinal axis 40 of the apparatus. Five equally spaced nozzles 42 extend through cylindrical wall 26 to provide tangential communication with the interlacing chamber 32 from the manifold 28, and the axes of conduit 30, nozzles 42 and ports 38 are disposed in the plane of rotation of balls 34. The apparatus is clamped together by a pair of circular flanges 44 and 46 having inlet and outlet apertures 48 and 50 therein, respectively, to permit passage of yarn 52 through the interlacing zone in the apparatus between a pair of yarn guides 54 and 56 under slight tension. The flanges 44 and 46 are locked together by milled screws 58 and 60.

The operation of the apparatus of FIGS. 3 and 4 is similar to that described above with respect to FIG. 2 in that compressed air is forced from the manifold 28 through the nozzles 42 to be disrupted by the balls 34 prior to application to the yarn 52 through ports 38. The circular flanges 44 and 46 are spaced to define toroidal channel in interlacing chamber 32 between cylindrical wall 26 and barrel 36 such that the balls 34 are movable by the fluid currents from nozzles 42 to deflect the fluid currents and vary the direction of impact of the fluid currents through ports 38 on the yarn 52 as well as varying the flow of the fluid currents contacting the yarn.

Figure 5:
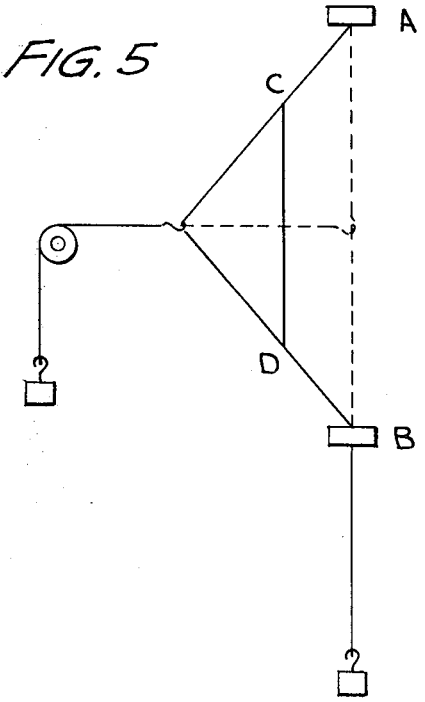
FIG. 5 is an illustrative diagram of apparatus for measuring the cohesion factor of interlaced yarns obtained by the method and apparatus of the present invention.

Apparatus is diagrammatically illustrated in FIG. 5 for measuring the cohesion factor of interlaced yarn produced in accordance with the method and apparatus of the present invention by the triangle test method. In accordance with the triangle test method, one meter of yarn is vertically arranged and measured under a pretension of 0.18 g/dtex between two stationary points A and B. After this measurement, a hook grasps the yarn at a point equidistant from points A and B, the hook engaging the middle of the bundle formed by the elementary strands of the interlaced yarn to take only half of the strands. The hook is then subjected to a force perpendicular to a line connecting points A and B, such traction force being 0.27 g/dtex to tend to separate the strands caught in the hook from the strands not caught by the hook. The traction force is exerted by gravity by means of a wire attached at one end of the hook and passing over an idle pulley to receive a weight at its other end corresponding to the traction force to be exerted. Under the influence of the traction force exerted on the strands caught in the hook, the caught strands have a tendency to separate from the remaining strands forming a triangle with points A and B; however, due to the holding or cohesion effect caused by the pseudo-knots formed in the interlaced yarn, the base of the triangle corresponds to a straight line segment CD which is less than the distance between points A and B. The cohesion factor is formulated in accordance with the difference between the distances AB and CD. Three measurements are made per sample, and the average of the three values measured is utilized, expressed in centimeters.

The method and apparatus of the present invention will now be illustrated by reference to the following specific examples. It is to be understood that such examples are presented for purposes of illustration only and the present invention is in no way to be deemed as limited thereto. In the following examples, the interlaced yarn is wound on a device with zero tension and pressures are measured with a pressure gauge.

EXAMPLE 1

The apparatus of FIG. 1 was used to treat a polyamide 66/2300 dtex/136 strands, texturized yarn having tetralobated section. The operating conditions were as follows:

| | |
|---|---|
| rate of passage of yarn through the apparatus | 135 m/min |
| compressed air fluid: feed pressure | 3 Kg/cm² |
| tension in interlacing zone | 26 g |
| diameter of ball | 9.75 mm |
| factor of cohesion of yarn, measured by the triangle test | 7 |

This example shows that it is possible to achieve a slight interlacing with a simple, single ball device.

EXAMPLE 2

The same yarn as in Example 1 was treated with the apparatus of FIGS. 3 and 4 by compressed air. The characteristics of the apparatus were made to vary in regard to the number of balls with a diameter of 9.75 mm and the number and size of ports 38.

| Test No. | Number of balls | Number of ports 38 and diameter in mm | | Compressed air pressure Kg/cm² | Rate of passage m/min | Cohesion factor |
|---|---|---|---|---|---|---|
| 1 | 6 | 5 | 1.5 | 4 | 415 | 69 |
| 2 | 0 | 5 | 1.5 | 4 | 415 | 4 |
| 3 | 0 | 3 | 2 | 4 | 415 | 19 |

This example, thus, establishes the role of the balls and the influence of the number and diameter of ports 38.

EXAMPLE 3

The same yarn as in Example 1 was treated with compressed air using the apparatus of FIGS. 3 and 4 with the ports 38 replaced by a circuit slit 1 mm wide to provide a passage for compressed air.

Six tests were made, varying the number of balls. The operating conditions were as follows:

| | |
|---|---|
| rate of yarn passage | 415 m/min |
| compressed air pressure | 4 Kg/cm² |
| yarn tension | 22 g |
| diameter of balls | 9.75 mm |

The results are given in the following table:

| Number of test | Number of balls | Cohesion factor |
|---|---|---|
| 4 | 6 | 10 |
| 5 | 5 | 15 |
| 6 | 4 | 6 |
| 7 | 3 | 6 |
| 8 | 2 | 8 |
| 9 | 0 | 5 |

This example, thus, shows the influence of the number of balls in the apparatus while other characteristics are fixed and, more particularly, that there is a number of balls providing optimum results and that starting from this value, the cohesion factor diminishes in a fairly regular manner with the number of balls.

EXAMPLE 4

To study the influence of the yarn passage rate and the pressure of the interlacing fluid, the same yarn as in Example 1 was treated, with the apparatus of FIG. 2 utilizing four balls with a diameter of 9.75 mm and supplied with compressed air. Eight tests were made whose results are given in the following table.

| Test No. | Yarn passage rate | Compressed air pressure Kg/cm² | Tension in interlacing zone in g | Cohesion factor in cm measured by triangle test |
|---|---|---|---|---|
| 10 | 100 | 2 | 21 | 5 |
| 11 | 100 | 3 | 25 | 1 |
| 12 | 100 | 4 | 27 | 26 |
| 13 | 100 | 5 | 32 | 6 |
| 14 | 400 | 4 | 20 | 8 |
| 15 | 400 | 5 | 25 | 22 |
| 16 | 550 | 4 | 20 | 0 |
| 17 | 550 | 5 | 23 | 3 |

Analysis of the results establishes that, for a given yarn passage rate, there is an optimal pressure for obtaining the best degree of interlacing, and that, in a general manner, the degree of interlacing diminishes as the yarn passage rate increases.

EXAMPLE 5

There was treated with compressed air a yarn of polyamide 66/2300 dtex/136 strands, non-texturized, with the apparatus of FIGS. 3 and 4 utilizing six balls with a diameter of 9.75 mm and five ports 38 with a diameter of 1.5 mm.

The operating conditions were as follows:

| | |
|---|---|
| yarn passage rate | 100 m/min |
| compressed air pressure | 4 Kg/cm² |
| yarn tension | 40 g |

A yarn was obtained with interlaced strands whose average cohesion factor, measured by the triangle test, was 48.

In the tests, it was established that the voluminosity was hardly affected by the interlacing treatment.

The present invention is not limited to the methods and apparatus described in the examples and specification and shown in the drawings, but rather many variations thereof are encompassed by the present invention. For instance, the axes of nozzles need not be coplanar and the nozzles can be disposed non-tangentially in relation to the chambers. In the apparatus of FIGS. 3 and 4, ports 60 can be pierced non-radially and longitudinally distributed at various levels. Similarly, the balls can be replaced with equivalent elements such as cylindrical or convex rolls.

The present invention is applicable to the interlacing of flat or texturized continuous yarns of all sizes and formed of all aritifical, synthetic materials used for making fabrics, unwoven knits, and other textile applications, in particular clothing and furniture.

Inasmuch as the present invention is subject to many variations, modifications and changes in detail, it is intended that all subject matter described above or shown in the accompanying drawings be interpreted as illustrative and not in a limiting sense.

What is claimed is:

1. Apparatus for interlacing strands of a textile yarn comprising:

a housing defining a cylindrical interlacing chamber for passage of the textile yarn axially therethrough;

means for introducing a fluid current into said interlacing chamber for treating the yarn, including at least a nozzle disposed to direct a fluid current non-radially into said interlacing chamber;

disturbing means including at least one element movably disposed in said interlacing chamber and movably by the fluid current, for disturbing the fluid current introduced into said interlacing chamber.

2. Apparatus as recited in claim 1 wherein said movable element is a ball.

3. Apparatus as recited in claim 1 wherein said fluid current introducing means includes a plurality of nozzles for introducing a plurality of fluid currents into said interlacing chamber.

4. Apparatus as recited in claim 3 wherein said disturbing means includes a plurality of elements movably disposed in said interlacing chamber and movable by the plurality of fluid currents.

5. Apparatus as recited in claim 4 wherein said movable elements are balls.

6. Apparatus for interlacing strands of a textile yarn comprising:

a housing defining an interlacing chamber for passage of the textile yarn, wherein said housing has a cylindrical wall disposed therein to define an annular manifold and, wherein a cylindrical barrel is disposed within said cylindrical wall to define an annular channel;

means for introducing a fluid current into said interlacing chamber for treating the yarn, wherein said means includes a conduit community with said manifold to supply compressed air thereto and a plurality of equally spaced nozzles in said cylindrical wall to supply a plurality of fluid currents to said interlacing chamber; and means for disturbing the fluid current introduced into the cylindrical barrel of said interlacing chamber to vary the impact of the fluid current on the yarn, wherein the disturbing means includes a plurality of balls movably disposed within said channel to vary the direction and flow of the fluid current.

* * * * *